US006158994A

United States Patent [19]

Mulcahy

[11] Patent Number: 6,158,994

[45] Date of Patent: Dec. 12, 2000

[54] GROOVED ROTOR FOR AN INTERNAL GEAR PUMP

[75] Inventor: Michael K. Mulcahy, Tinley Park, Ill.

[73] Assignee: Tuthill Corporation, Burr Ridge, Ill.

[21] Appl. No.: 09/295,947

[22] Filed: Apr. 21, 1999

[51] Int. Cl.[7] ..... F01C 21/04

[52] U.S. Cl. ..... 418/102; 418/168

[58] Field of Search ..... 418/102, 166, 418/168, 171, 77, 79

[56] References Cited

U.S. PATENT DOCUMENTS

| | | | |
|---|---|---|---|
| 1,271,970 | 7/1918 | Wood | 418/102 |
| 1,502,083 | 7/1924 | Zoelly | 418/87 |
| 2,998,783 | 9/1961 | Lee | 418/102 |
| 3,015,282 | 1/1962 | Camarata | 418/102 |
| 3,204,614 | 9/1965 | Huber | 418/94 |
| 3,205,875 | 9/1965 | Praxmarer et al. | 123/243 |
| 3,838,950 | 10/1974 | Andriulis | 418/76 |
| 3,951,117 | 4/1976 | Perr | 123/139 AQ |
| 4,106,446 | 8/1978 | Yamada et al. | 123/90.13 |
| 4,134,549 | 1/1979 | Perr | 239/92 |
| 4,470,752 | 9/1984 | Teruo et al. | 415/72 |
| 5,322,428 | 6/1994 | Hansen et al. | 418/91 |
| 5,634,783 | 6/1997 | Beal | 418/91 |
| 5,749,416 | 5/1998 | Belcher | 166/68.5 |

*Primary Examiner*—John J. Vrablik
*Attorney, Agent, or Firm*—Lee, Mann, Smith, McWilliams, Sweeney and Ohlson

[57] ABSTRACT

A rotor for an internal gear pump adapted to improve the lubrication of the internal gear parts. A radial groove is added to the inner face of an internal rotor. The groove extends radially between the center of the rotor and an outer diameter of the rotor. The groove provides a communication channel between the outer circumference of the rotor and the parts located within the rotor's inner diameter, namely the idler gear and idler pin. The disclosed grooved rotor improves the flow of fluid to the interface between the idler gear and the idler pin of a typical internal gear pump. Should the lubricating properties of the fluid be reduced and/or the operating pressures of the pump increased, the improved rotor design will provide lubrication of the internal rotary parts, thereby decreasing the friction among the parts and extending the overall productive life of the pump.

8 Claims, 1 Drawing Sheet

GROOVED ROTOR FOR AN INTERNAL GEAR PUMP

BACKGROUND OF THE INVENTION

This invention relates to improvements in the lubrication of internal surfaces for internal gear pumps. More particularly, this invention relates to an improvement in the design of a gear pump's internal rotor such that the lubrication between the interface of the idler gear and the idler pin is greatly improved.

In a rotary internal gear pump, the idler gear rotates on a stationary pin. The idler gear is contained within the inner diameter of the rotor, the rotor's backwall and the face of the cover. The vast majority of the applications can have the idler gear rotate on the stationary idler pin without problem as the fluid being pumped provides sufficient lubrication. However, as the lubricating properties of the fluid are reduced and/or the operating pressures are increased, there has become a need for additional design features to aid in getting the fluid to the interface of the idler gear inner diameter and the idler pin outer diameter.

Previous designs have accomplished this by drilling one or more holes through the root of the idler gear, or by adding a groove on the face of the cover from the pressure side of the pump.

A need has arisen for an improved design for an internal gear pump. The present invention discloses an improved design for a rotor for an internal gear pump that greatly enhances the flow of fluid between the interface of the idler gear and the idler pin to provide lubrication.

SUMMARY OF THE INVENTION

The disclosed grooved rotor efficiently improves the flow of fluid to the interface between the idler gear and the idler pin of a typical internal gear pump. Should the lubricating properties of the fluid be reduced and/or the operating pressures of the pump increased, the improved rotor design will increase lubrication of the internal rotary parts, thereby decreasing the friction among the parts and extending the overall productive life of the pump.

In a preferred embodiment, a radially extending groove is added to the inner face of the rotor. The groove extends radially between the outer diameter of the rotor and center of the rotor. The groove provides a communication channel between a fluid reservoir in communication with the outer circumference of the rotor and the interface between the idler gear and idler pin. Pressurized fluid is forced to pass radially inwardly along the groove to the idler gear/pin interface.

DETAILED DESCRIPTION OF THE PREFERRED EMBODIMENT

Figure 1:
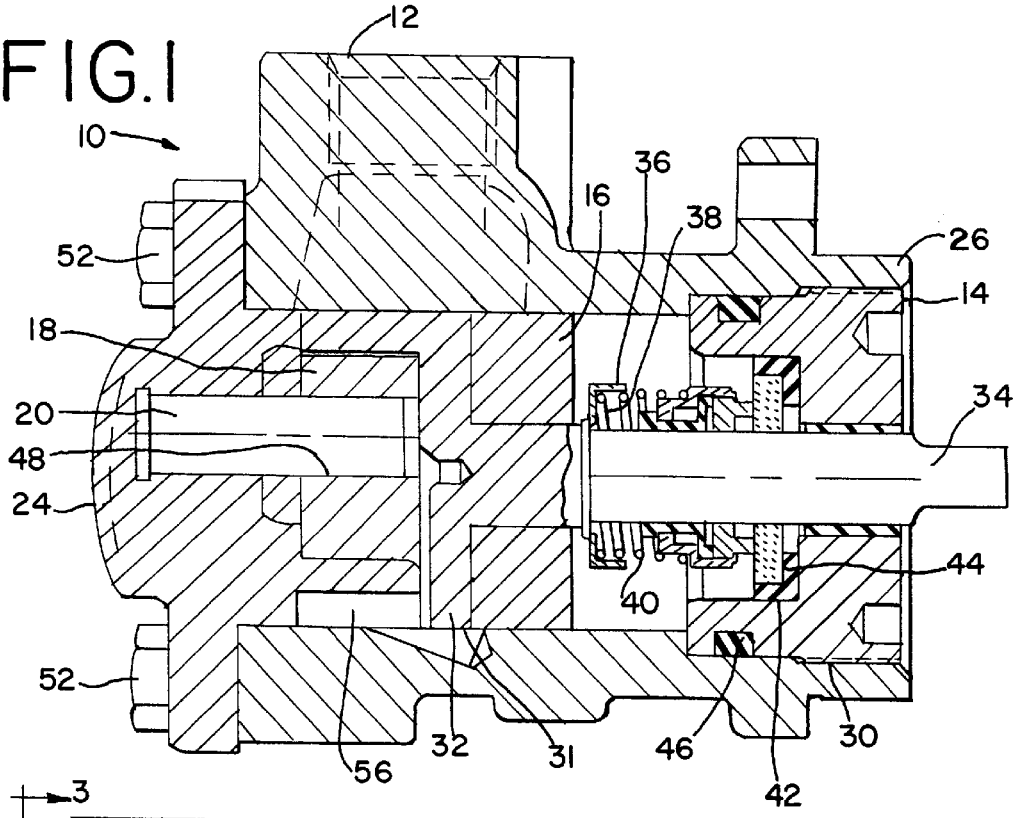
FIG. 1 is a cross-sectional view of an internal gear pump which includes the radial grooved rotor.

The present invention is directed to a rotor for an internal gear pump which is adapted to provide communication channels that allow for the flow of fluid from the rotor's outer circumference to its hollow interior. The rotor of the present invention is illustrated and described in the operational environment of an internal gear pump as described herein but is believed to have broad applications above and beyond the description of this preferred embodiment. As shown in FIG. 1, the internal gear pump of the preferred embodiment, generally designated with the numeral 10, includes a housing member 12, a housing plug 14, a housing bushing 16, an idler gear 18, an idler pin 20, a rotor 22, and a cover plate 24.

The housing member 12 has an internally threaded first end 26 and a second end which is defined by the cover plate 24. A first chamber 30 is defined within the first end 26 of the housing member 12 and a second chamber 31 is defined throughout the rest of the housing member 12.

Figure 2:
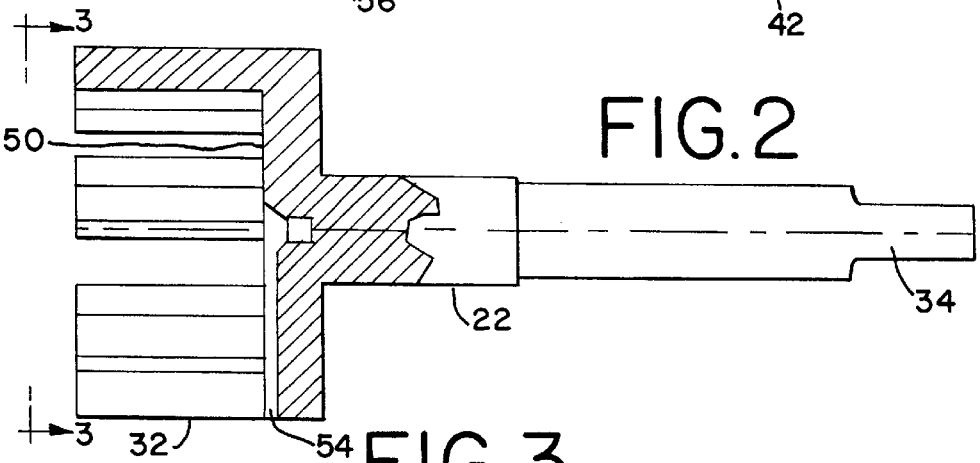
FIG. 2 is a cross-sectional view of the radial grooved rotor.
Figure 3:
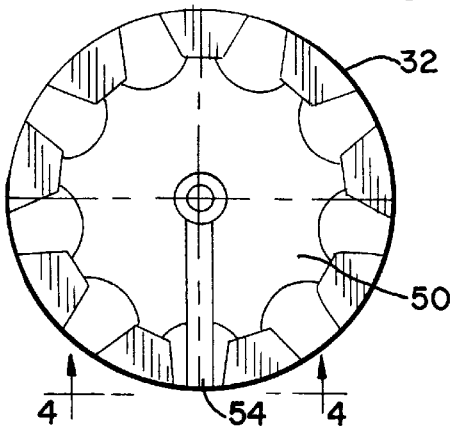
FIG. 3 is a sectional view of the radial grooved rotor, taken along sectional line 3—3 of FIG. 2.
Figure 4:
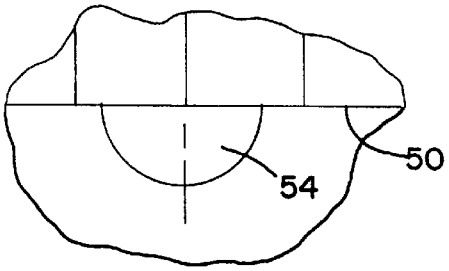
FIG. 4 is a sectional view of the radial grooved rotor, taken along sectional line 4—4 of FIG. 3.

The rotor 22 is rotatably disposed within the second chamber 31 and adapted to rotate about its central axis. The rotor 22 includes a cup-shaped portion 32, best seen in FIG. 2, and an input shaft 34. The housing bushing 16 is disposed within the second chamber 31 and adjacent the cup-shaped portion 32 of the rotor 22. The housing bushing 16 allows the input shaft 34 to extend therethrough and supports the shaft for rotation.

Also disposed within the chamber 30 is a retaining ring 36, located adjacent the housing bushing 16. A third chamber 38 is defined within the retaining ring 36 for housing a resilient biasing member shown in the form of a retention spring 40 disposed within the third chamber 38.

Adjacent the retaining ring is the housing plug 14. The housing plug 14 is externally threaded to be secured to the internally threaded first end 26 of the housing member 12, and is counterbored to produce a fourth chamber 42. A sealing member 44 is disposed within the fourth chamber 42 such that the retention spring 40 is compressed between the retaining ring 36 and sealing member 44. The retention spring 40 is adapted to urge sealing member 44 to engage the housing plug 14, effecting a frontal compression of the sealing member 44 and preventing the leakage of the pressurized fluid along the housing plug-seal interface and into chamber 30. A second sealing member 46, illustrated as an 0-ring, is internally disposed in a groove formed in the housing plug 14.

The cup-shaped portion 32 of the rotor 22 has an outer diameter slightly less than the inner diameter of second chamber 31 and an inner diameter greater than the outer diameter of idler gear 18, which is disposed within portion 32 when the pump is assembled. The rotor 22 is adapted to engage the idler gear 18 to effect the rotary movement thereof The idler gear 18, which defines an aperture 48 therethrough, is adapted to rotate about idler pin 20. Idler pin 20 is fixed against rotation and extends outwardly from the inner surface of cover plate 24 within aperture 48, and towards the inner surface 50 of cup-shaped chamber 32. The diameter of the aperture 48 is slightly greater than the diameter of the idler pin 20 so as to allow fluid flow along the interface between the outer diameter of the idler pin and the inner diameter of the idler gear. Cover plate 24 is secured to the second end of the housing member by cover bolts 52.

The inner surface 50 of cup-shaped member 32 lies in a plane substantially perpendicular to the central axis of the rotor 22. A communication channel or groove 54 is defined in the inner surface 50 of rotor 22 and extends radially between approximately the central axis of the rotor 22 and the outer diameter of the cup-shaped portion 32 of the rotor 22. The communication channel 54 is adapted to communicate pressurized fluid from a fluid sump 56 to the interior of the cup-shaped portion 32. The introduction of fluid within the cup-shaped portion 32 allows the lubrication of the interface between the idler gear 18 and the idler pin 20, and the idler gear 18 and the rotor 22.

Fluid is caused to flow from the sump 56, radially inwardly along the channel 54 when the fluid in the sump 56 is pressurized during pump operation. When the pressurized fluid exerts a force greater than the centrifugal force caused by the rotation of the rotor, the fluid will flow radially inwardly through channel 54 until it reaches the passageway which defines the interface between outer diameter of the idler pin 20 and the inner diameter of the aperture 48. The pressurized fluid then flows along this passageway providing lubrication along this passageway thereby reducing friction.

Various features of the invention have been particularly shown and described in connection with the illustrated embodiment of the invention. However, it must be understood that these particular arrangements merely illustrate, and that the invention is to be given its fullest interpretation within the terms of the appended claims.

What is claimed is:

1. A rotor especially adapted to provide enhanced lubrication in an internal gear pump including:

a cup-shaped portion adapted to receive one or more gear members therein, said cup-shaped portion having a linearly extending central axis, an inner face surface of said cup-shaped portion lying in a plane substantially perpendicular to said central axis;

a laterally extending shaft attached to said cup-shaped portion for rotation therefore, said shaft extending along said center-axis; and at least one radially extending fluid passage groove defined in said inner face surface, said groove extending radially between the central axis and a fluid source so as to facilitate the passage of fluid from said fluid source to said central axis, whereby when said rotor rotates, said groove collects lubricating fluid located outside of said cup-shaped portion and directs the fluid toward said center-axis, thereby lubricating the interior of said cup-shaped portion.

2. A rotor in accordance with claim 1 wherein said rotor further includes a plurality of spaced apart teeth extending axially from said cup-shaped member of said rotor, said spaced apart teeth defining spaces between adjacent teeth, said fluid passage groove extending radially between the central axis and one of said spaces.

3. A rotor in accordance with claim 1 wherein said fluid passage groove has a groove surface defined by said inner surface of said cup-shaped member.

4. A rotor in accordance with claim 3 wherein said grooved surface is concave.

5. A rotary internal gear pump (10) including:

a housing defining a fluid inlet and outlet;

a chamber defined within said housing member;

a cover enclosing one end of said housing member;

an idler pin fixedly mounted in said chamber;

an idler gear disposed within said chamber and rotatably mounted about said idler pin;

a fluid passage defined between said idler pin and said idler gear;

a rotor disposed within said chamber and adapted to operatively engage said idler gear, said rotor including a cup-shaped member with an inner surface thereof lying in a plane substantially perpendicular to a central axis of said rotor; and a fluid passage groove defined in said inner surface of said cup-shaped member extending radially between approximately the central axis of said rotor and an outer diameter of said rotor, said fluid passage groove adapted to communicate pressurized fluid between a fluid source and the interior of said cup-shaped member to facilitate lubrication of the idler gear.

6. A rotary internal gear pump in accordance with claim 5 wherein said rotor further includes a plurality of spaced apart teeth extending axially from said cup-shaped member of said rotor, said spaced apart teeth defining spaces therebetween, said fluid passage groove extending radially between the central axis of said rotor and a space between adjacent teeth.

7. A rotary internal gear pump in accordance with claim 5 wherein said fluid passage groove has a groove surface defined by said inner surface of said cup-shaped member.

8. A rotary internal gear pump in accordance with claim 7 wherein said grooved surface is substantially concave.

* * * * *